US010373817B2

(12) United States Patent
Makarov et al.

(10) Patent No.: US 10,373,817 B2
(45) Date of Patent: Aug. 6, 2019

(54) METHOD FOR DETERMINING THE STRUCTURE OF A MACROMOLECULAR ASSEMBLY

(71) Applicants: Thermo Fisher Scientific (Bremen) GmbH, Bremen (DE); UNIVERSITEIT MAASTRICHT, Maastricht (NL); UNIVERSITEIT UTRECHT HOLDING B.V., Utrecht (NL)

(72) Inventors: Alexander Alekseevich Makarov, Bremen (DE); Ronald M. A. Heeren, Maastricht (NL); Albert J. R. Heck, Utrecht (NL)

(73) Assignees: Thermo Fisher Scientific (Bremen) GmbH, Bremen (DE); Universiteit Maastricht, Maastricht (NL); Universiteit Ultrecht Holding B.V., Utrecht (NL)

( * ) Notice: Subject to any disclaimer, the term of this patent is extended or adjusted under 35 U.S.C. 154(b) by 0 days.

(21) Appl. No.: 16/042,088

(22) Filed: Jul. 23, 2018

(65) Prior Publication Data

US 2019/0051507 A1 Feb. 14, 2019

Related U.S. Application Data

(63) Continuation of application No. 15/534,958, filed as application No. PCT/EP2015/079109 on Dec. 9, 2015, now Pat. No. 10,032,618.

(30) Foreign Application Priority Data

Dec. 12, 2014 (GB) ..... 1422142.8

(51) Int. Cl.
*H01J 49/40* (2006.01)
*H01J 49/00* (2006.01)

(52) U.S. Cl.
CPC ..... *H01J 49/40* (2013.01); *H01J 49/0004* (2013.01); *H01J 49/0036* (2013.01); *H01J 49/0045* (2013.01)

(58) Field of Classification Search
CPC .... H01J 49/00; H01J 49/0004; H01J 49/0036; H01J 49/0045
See application file for complete search history.

(56) References Cited

U.S. PATENT DOCUMENTS 4,093,855 A 6/1978 Fite et al.
5,245,186 A 9/1993 Chait et al.
(Continued)

FOREIGN PATENT DOCUMENTS

CN 102510903 A 6/2012
CN 103389335 A 11/2013
JP 2005-337903 A 12/2005

OTHER PUBLICATIONS

Bull et al., "Account: An introduction to velocity-map imaging mass spectrometry (VMImMS)", Eur. J. Mass Spectrom. (2014), 20, pp. 117-129.

(Continued)

*Primary Examiner* — Nicole M Ippolito
*Assistant Examiner* — Sean M Luck
(74) *Attorney, Agent, or Firm* — Charles B. Katz

(57) ABSTRACT

A method of determining the structure of a macromolecular assembly (MMA) comprises the steps of (a) generating precursor ions of an MMA species to be investigated; (b) transporting the MMA precursor ions to a fragmentation zone; (c) carrying out pulsed fragmentation of the MMA precursor ions in the fragmentation zone; (d) for a first plurality of MMA precursor ions, detecting both a spatial distribution of the resultant MMA fragment ions, and an m/z distribution of the MMA fragment ions; (e) analyzing the spatial and m/z distributions of fragment ions formed from (Continued)

the said first plurality of precursor ions of the MMA species to be investigated, to determine the relative positions of those fragment ions within the structure of the precursor MMA; and (f) reconstructing the three dimensional (3D) structure of the MMA from the analysis of the spatial and m/z distributions of fragment ions.

15 Claims, 7 Drawing Sheets

(56) References Cited

U.S. PATENT DOCUMENTS

| | | | | |
|---|---|---|---|---|
| 6,011,259 | A * | 1/2000 | Whitehouse | H01J 49/004 250/287 |
| 2003/0083483 | A1 | 5/2003 | Ecker et al. | |
| 2006/0284080 | A1 * | 12/2006 | Makarov | H01J 49/004 250/290 |
| 2007/0114390 | A1 | 5/2007 | Laskin et al. | |
| 2008/0001080 | A1 | 1/2008 | Suits et al. | |
| 2009/0090853 | A1 * | 4/2009 | Schoen | H01J 49/004 250/282 |
| 2010/0294924 | A1 | 11/2010 | Brouard et al. | |
| 2011/0291003 | A1 * | 12/2011 | Kou | H01J 49/0031 250/288 |

OTHER PUBLICATIONS

Chichinin et al., "Imaging chemical reactions—3D velocity mapping", International Reviews in Physical Chemistry, vol. 28 (4), 2009, pp. 607-680.

Clark et al., "Multimass Velocity-Map Imaging with the Pixel Imaging Mass Spectrometry (PlmMS) Sensor: An Ultra-Fast Event Triggered Camera for Particle Imaging", J. Phys. Chem. A 2012, 116, pp. 10897-10903.

Nomerotski et al., "Pixel imaging mass spectrometry with fast silicon detectors", Nuclear Instruments and Methods in Physics Research A 633 (2011), pp. S243-S246.

Papalazarou et al., Combined electrospray ionization source with a velocity map imaging spectrometer for studying large gas phase molecular ions, Analyst, 2012, 137, pp. 3496-3501.

* cited by examiner

METHOD FOR DETERMINING THE STRUCTURE OF A MACROMOLECULAR ASSEMBLY

CROSS-REFERENCE TO RELATED APPLICATIONS

The present application is a continuation under 35 U.S.C. § 120 and claims the priority benefit of co-pending U.S. patent application Ser. No. 15/534,958, filed Jun. 9, 2017, which is a National Stage application under 35 U.S.C. § 371 of PCT Application No. PCT/EP2015/079109, filed Dec. 9, 2015. The disclosures of each of the foregoing applications are incorporated herein by reference.

FIELD OF THE INVENTION

The present invention relates to a method for determining the structure of a macromolecule or macromolecular assembly (MMA).

BACKGROUND TO THE INVENTION

In biochemistry, the term "macromolecules" is applied to molecules of large molecular mass and broadly includes biopolymers such as nucleic acids, proteins, and carbohydrates as well as non-polymeric molecules such as lipids and macrocycles.

Macromolecular assemblies (MMAs) are massive chemical structures (typically hundreds of kDa or even several MDa) and encompass large biological molecules such as viruses, protein complexes, protein-ligand complexes, protein-DNA complexes, antibody receptors and other complex mixtures of polypeptides, polysaccharides and so forth, and also non-biological materials such as nanoparticles.

Herein the term macromolecular assemblies (MMAs) will be used to refer to both macromolecules and macromolecular assemblies.

Macromolecular assemblies are defined both by their compositional structure and also by their chemical shape. The 3D shape (conformation) of the MMA is often of a great interest because, for example, knowledge of the shape of an MMA can help in the understanding of how that MMA interacts with other molecules. Applications of structural and dynamic MMA analyses range from the detailed study of equilibria and dynamic interconversions between different MMA structures as influenced by environmental changes or binding of substrates or cofactors, to the analysis of intact nano-machineries such as whole virus particles, organelles, proteasomes and ribosomes.

Generally, 3D structural information is not widely available even for many known proteins or protein complexes, therefore the problem of determining the structure of MMAs is still acute.

Various methods and techniques for experimentally investigating MMA structure exist. An introductory review of these is given in "From words to literature in structural proteomics", by Sali et al, Nature 422, 216-225, Mar. 13, 2003. Techniques such as x-ray crystallography, nuclear magnetic resonance, 2 dimensional electron microscopy, cryoelectron tomography, and many others each provide different perspectives on the 3D shape of MMAs. Each in turn has advantages and disadvantages over other techniques.

The present invention proposes an alternative approach to that described in the art, for the determination of the structure of an MMA.

SUMMARY OF THE INVENTION

In accordance with a first aspect of the present invention, there is provided a method of determining the structure of a macromolecular assembly (MMA) comprising the steps of generating precursor ions of an MMA species to be investigated; transporting the MMA precursor ions to a fragmentation zone; carrying out pulsed fragmentation of the MMA precursor ions in the fragmentation zone; for a first plurality of MMA precursor ions, detecting both a spatial distribution of the resultant MMA fragment ions, and an m/z distribution of the MMA fragment ions; and analyzing the spatial and m/z distributions of fragment ions formed from the said first plurality of precursor ions of the MMA species to be investigated, to determine the relative positions of those fragment ions within the structure of the precursor MMA.

The present invention thus proposes an approach wherein the three dimensional structure of an MMA may be directly determined through mass spectrometric imaging of complementary products of MMA fragmentation, using a pulsed fragmentation technique. In preference, a high frequency, high power pulsed laser is employed. Multiple images of the results of the pulsed fragmentation are collected, in preference, and clustering techniques may be applied to the multiple images in order to construct a three dimensional image of the MMA species of interest. In particular, the method may comprise establishing from the plurality of spatial and m/z distributions of the fragment ions correlations of the relative positions of the fragments within the MMA species. The m/z values of the MMA fragment ions may be determined from the detection and from the m/z values the chemical identity of the MMA fragment ions may be determined. In this way, the method can provide as an output the positions of the fragments within the MMA species as well as their chemical identity.

A second mode of operation may be employed to provide additional information regarding the identity of MMA fragment ions. In the second mode, instead of obtaining both a spatial distribution and m/z distribution of the fragment ions, the ions may instead be captured and directed into a high resolution mass analyzer such as an orbital trapping mass analyzer for analysis there.

The invention also extends to a mass spectrometer comprising an ion source for generating precursor ions of an MMA species to be investigated; an ion detector arrangement having detector ion optics and a 2D detector; pulsed fragmentation means for fragmenting the MMA precursor ions in a fragmentation zone positioned between the ion detector arrangement and the ion source; ion optics for transporting the MMA precursor ions from the ion source to the fragmentation zone; and a processor; wherein, for a first plurality of MMA precursor ions, the 2D detector of the ion detector arrangement is arranged to detect both a spatial distribution of MMA fragment ions generated by the pulsed fragmentation means, and an m/z distribution of those MMA fragment ions; and further wherein the processor is configured to analyze the spatial and m/z distributions of MMA fragment ions formed from the said first plurality of precursor ions of the MMA species to be investigated, so as to determine the relative positions of those MMA fragment ions within the structure of the precursor MMA.

Further preferred features of the present invention are set out in the appended claims.

BRIEF DESCRIPTION OF THE DRAWINGS

The invention may be put into practice in a number of ways and some preferred embodiments will now be described by way of example only and with reference to the accompanying drawings in which.

DETAILED DESCRIPTION OF A PREFERRED EMBODIMENT

Figure 1:
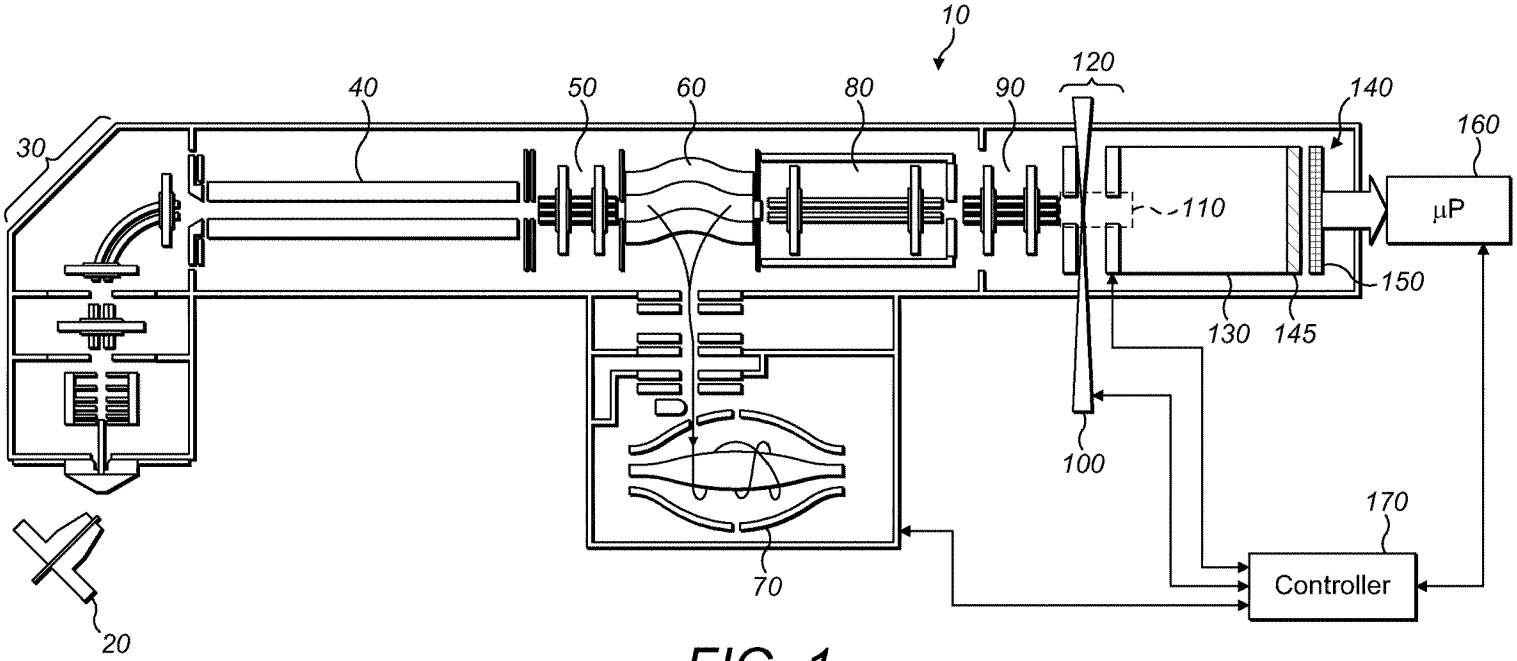
FIG. 1 shows a first embodiment of a mass spectrometer embodying the present invention and including an electrode arrangement for directing MMA fragment ions towards a detector arrangement.

FIG. 1 shows, in schematic form, a mass spectrometer 10 in accordance with an embodiment of the present invention. The mass spectrometer 10 comprises an ion source such as an atmospheric pressure ion source 20. The ion source is arranged to generate continuous or quasi continuous supply of ions of a macromolecular assembly (MMA) whose structure and topography are to be investigated. The MMA is taken from solution and converted into gas phase ions using electrospray process as known in the art. The MMA may be, for example, a protein, protein complex, nucleic acid, polysaccharide, lipid, macrocycles, virus, antibody or other large molecule or assembly. The invention is particularly useful for analysis and structural and conformational determination on large molecules of mass at least 50 kDa (kiloDalton), or at least 100 kDa, or at least 200 kDa, at least 500 kDa, or at least 1 MDa (MegaDalton). The molecules are preferably non-covalently bound complexes, e.g. non-covalently bound protein complexes, especially in the aforesaid mass ranges. The MMA may be ionised from a native state, i.e. with the MMA at near-physiological conditions (e.g. at approximately neutral pH). Generally, the MMA precursor ions are generated as multiply-charged ions. Preferably, the total charge of the resultant MMA fragments does not exceed the initial charge of the MMA precursor ion. Due to the high mass of the fragments, it is generally possible to detect them only if they are post-accelerated to sufficient energy (e.g. 10-30 keV, especially 20-30 keV), which requires that each of the fragments carries at least some charge.

MMA precursor ions, in gaseous form enter the mass spectrometer 10 from the ion source 20 and pass through the first ion optics and a bent multipole 30. The ion optics, bent multipole and all components downstream of that are held under vacuum. The ions then enter a quadrupole mass filter 40. Ions of a particular species to be investigated can be selected by the quadrupole mass filter 40. For example, a single charge state or single modification may be selected. The selected ions then pass from the quadrupole mass filter 40, through second ion optics 50 and into a curved linear ion trap (C-trap) 60. The MMA precursor ions continue through the C-trap 60 (i.e. in a longitudinal direction without orthogonal ejection) and into an higher collision energy dissociation (HCD) cell. The HCD cell 80 is operable in two modes, in a first mode, MMA precursor ions are allowed to pass through the HCD cell 80 without fragmentation. In a second mode, the MMA precursor ions may be fragmented in the HCD cell 80 prior to further processing downstream.

The invention may most readily be understood by another explanation of the processing of the MMA precursor ions in the first mode, wherein the MMA precursor ions of the chosen species are allowed to pass through the HCD cell 80 without fragmentation there. These ions exit the HCD cell 80 and enter a multipole 90. Immediately downstream of the multipole 90 is an electrode arrangement 120. The electrode arrangement 120 comprises, in the schematic drawing of FIG. 1, first and second electrodes 120*a*, 120*b* which are spaced in the direction of ion flight through the mass spectrometer 10. The first and second electrodes 120*a*, 120*b* forming the electrode arrangement 120 also have apertures which are aligned with each other and with the flight axis of the mass spectrometer 10. These first and second electrodes 120*a*, 120*b* provide an acceleration gap. A region defined by the volume between the first and second electrodes 120*a*, 120*b* of the electrode arrangement 120 and a distance extending orthogonally from the longitudinal axis of the mass spectrometer 10 defines a fragmentation zone 110 which is shown in dotted form in FIG. 1. It is to be understood that the fragmentation zone 110 is a useful concept to aid in the understanding of the invention and that the precise extent of the volume is not, in most general embodiments of the invention, exactly defined. Indeed, as will be explained further in connection with FIG. 6, particularly preferred embodiments of the present invention provide for means for focussing MMA precursor ions within a relatively small volume.

A pulsed high power laser 100 is directed at the fragmentation zone 110, with its focal region lying within the fragmentation zone 110, most preferably, between the first and second electrodes of the electrode arrangement 120 but closer to the first electrode (the electrode near the multipole 90) than to the second electrode downstream the flight axis of the mass spectrometer 10). Typically, the focal region of the pulsed laser 100 may be a few millimeters from the first electrode of the electrode arrangement 120 in that flight direction, and lies on that longitudinal axis of the mass spectrometer 10.

The pulsed laser 100 runs at a high frequency of between 10 and 10,000 Hz. Laser power densities in excess of $10^{10}$ Watts/$m^2$ are delivered along with energy densities in excess of 100 J/$m^2$. Any wavelength, from IR to UV, can be employed.

It is desirable that the flow of MMA precursor ions is adjusted such that, on average, no more than one MMA precursor ion is found in the focal region/fragmentation zone 110 simultaneously. If an MMA precursor ion happens to be intercepted by the laser pulse, it is rapidly heated and explosively fragmented (on a nanosecond timescale).

The resulting fragments are accelerated between the two electrodes 120*a*, 120*b* of the electrode arrangement 120, between 10 and 30 kV. Post-acceleration of the formed ion fragments is necessary in the case of large molecules, e.g. hundreds of kDa or more. Accelerated fragments enter a time of flight (TOF) region of the mass spectrometer. The TOF region has a liner 130 and a detector arrangement 140. MMA fragment ions exit the fragmentation zone 110 having been accelerated by the electrode arrangement 120, fly through the TOF region and strike the detector arrangement 140.

The detector arrangement 140 includes a micro channel plate (MCP) 145 immediately in front of a 2D detector 150. MMA fragment ions separate by time-of-flight in accordance with their mass to charge ratio m/z over the TOF region and hence strike the MCP 145 at different times. Here, they are converted into electrons. Those electrons are multiplied in well-known manner number and hence, an amplified signal may then be registered by the 2D detector behind the MCP 145. In this way, the m/z distribution of the individual MMA fragment ions is deduced from their time-of-flight as measured from the moment of acceleration. The 2D detector registers the electrons in two dimensions (x, y) on the detector surface to provide a 2D (x, y) spatial distribution of the MMA fragment ions at the detector. As will be shown hereafter, the 2D detector surface may be planar or curved.

In preference, the 2D detector 150 includes one or more TIMEPIX chips (for example, a single 65 kpixel chip or 4 together in a "quad" configuration presenting a 256 kpixel array). X. Liopart et al, Nucl. Instrum. Meth. Phys. Res. A 581 (2007), pages 485-494 describes a two dimensional array with such TIMEPIX chips. The general concept of using such a 2D detector 150 behind a micro channel plate is disclosed, in respect of a simple linear MALDI-TOF analyzer in U.S. Pat. No. 8,274,045, and in a SIMS-TOF in A Kiss et al, REV. Sci. Instrum. 84,013704 (2013). The detector allows the acquisition of tens to hundreds (for multi-chip detectors) of thousands of pixels in parallel with a temporal resolution that currently limits the m/z resolving power to just a few hundred.

The spatial distribution of the resultant MMA fragment ions detected refers to their position on the 2D detector. Each individual MMA fragment is converted into an (m/z, x, y) image of detected fragments.

The output of the 2D detector 150 is captured by a microprocessor 160.

The mass spectrometer 10 is under the overall control of a controller 170. In FIG. 1, the controller's main connections, insofar as they are relevant to the understanding of the present invention, are illustrated in schematic form but it will of course be understood that the controller may control other parts of the mass spectrometer as well. It will also, of course, be understood that the controller 170 and the microprocessor 160 may in reality be formed as a part of the same either dedicated processing circuitry or computer. The controller 170 synchronizes the 2D detector 150 with the pulses from the pulsed laser 100. This allows the time-of-flight of MMA fragment ions at the detector arrangement 140 to be used to deduce the m/z of the fragment ions.

Figure 2:
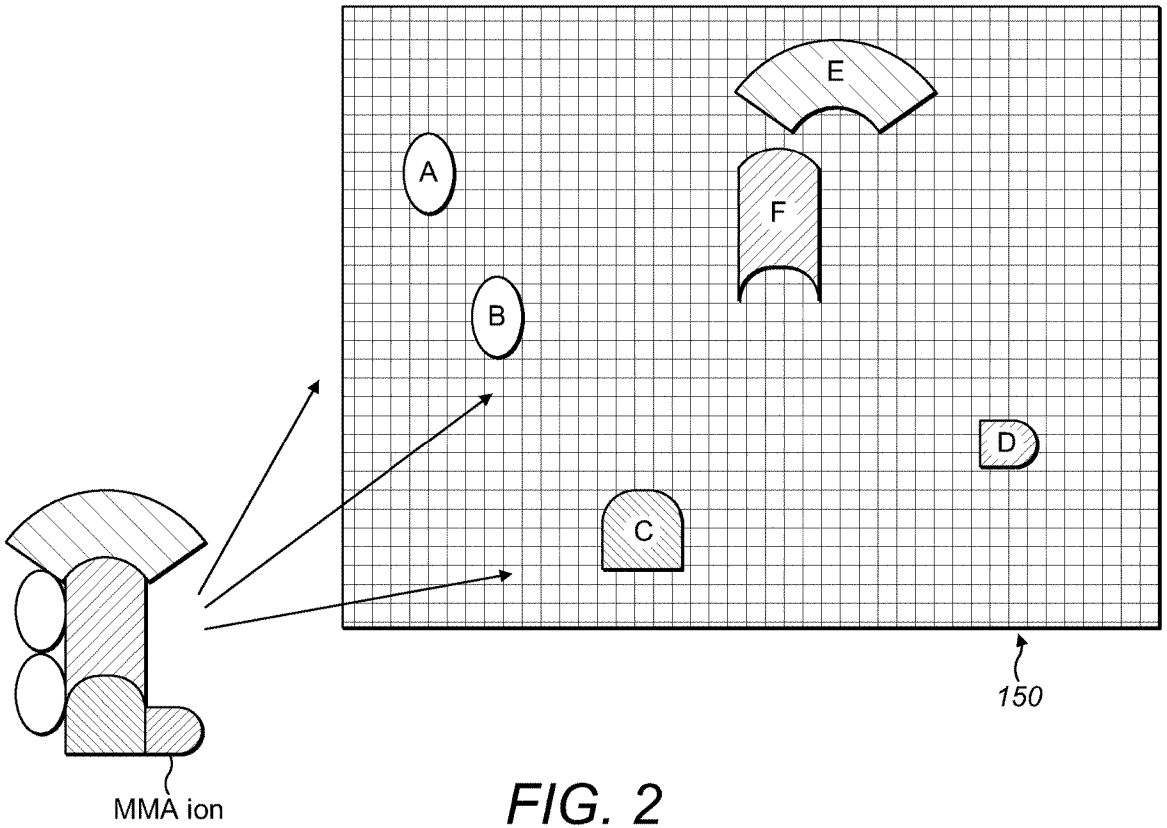
FIG. 2 shows, in schematic form, the structure of an MMA prior to fragmentation, and the position of fragments of that MMA upon a 2D detector forming a part of the detector arrangement of FIG. 1.

FIG. 2 illustrates schematically the fragmentation of the MMA precursor ions into the MMA fragment ions and their arrival at the 2D detector 150. In FIG. 2, an MMA precursor ion is shown on the left-hand side, prior to fragmentation. Of course, the MMA precursor ion will typically have a complex or very complex structure and the simplistic illustration in FIG. 2 is intended merely to explain how different parts of the MMA precursor ion may be spatially arranged within the MMA, and how those differently spatially arranged constituent parts might strike the 2D detector 150 of the detector arrangement 140 upon fragmentation of the MMA precursor ions. It should be noted again that as these fragments have different m/z, they strike detector 150 at different moments of time therefore FIG. 2 represents the moment after the last fragment reached detector 150. Fragments carrying no charge are likely to produce no detection event due to very low kinetic energy.

In general terms constituent parts of the MMA precursor ion on opposing sides will diverge in broadly opposite directions following fragmentation and thus, following acceleration, will arrive at opposite regions of the 2D detector relative to the position of center of mass of the MMA fragment distribution. For example, it may be seen that the constituent parts A and B, shown on the left-hand side of the MMA precursor ion prior to fragmentation, strike the 2D detector 150 on the left-hand side thereof whereas the constituent part D, on the opposite side of an arbitrary longitudinal axis of the MMA precursor ion, strikes the 2D detector 150 towards the right-hand side thereof.

For each MMA precursor ion which is fragmented, the resultant (m/z, x, y) image of detected fragments is stored. Many of these (e.g. hundreds to tens of thousands) are analyzed together using processing methods to be described below. Each image, even from the same MMA precursor ion species, will contain a different pattern of x and y positions for given fragments, as a result of different alignments of the MMA precursor ion relative to the detector arrangement 140 prior to fragmentation. Even using techniques to be outlined below in connection with FIG. 6, to try to ensure common alignment of MMA precursor ions along at least their dipolar axis, there will nevertheless be different MMA fragment ion images (m/z, x, y), depending upon the rotational orientation of the MMA precursor ion upon arrival at the fragmentation zone 110.

It is for this reason that it is desirable that on average, no more than a single MMA precursor ion is fragmented at any one time. MMAs are—or at least may be—of extremely complex structure and, if the fragments from more than one MMA precursor ion were to arrive simultaneously at the detector arrangement 140, the complexity of analysis/processing would be increased still further.

Figure 3A:
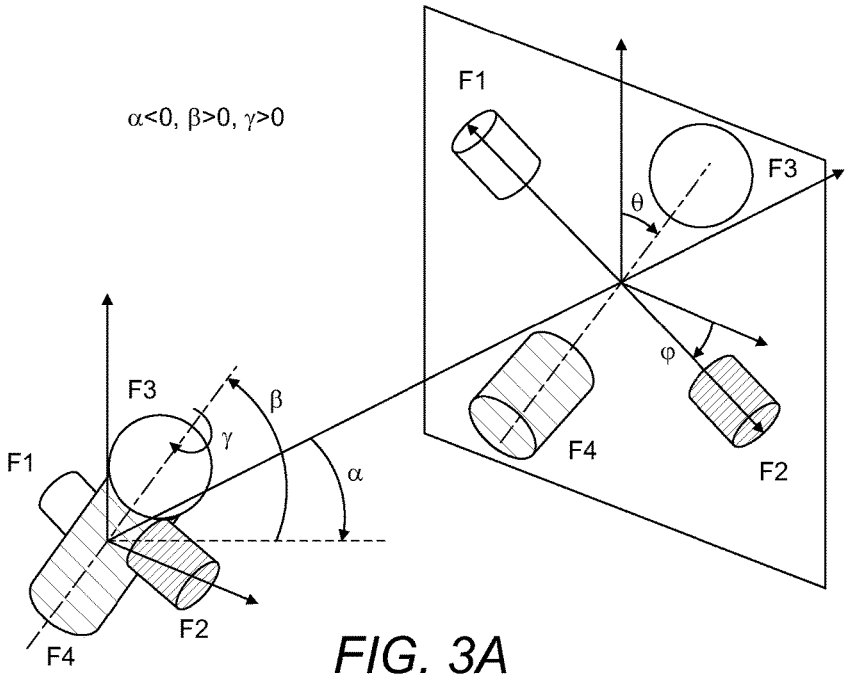
FIGS. 3A-3E show, also in schematic form, how different initial orientations of MMA are linked with projections of MMA fragments upon the 2D detector.
Figure 3B:
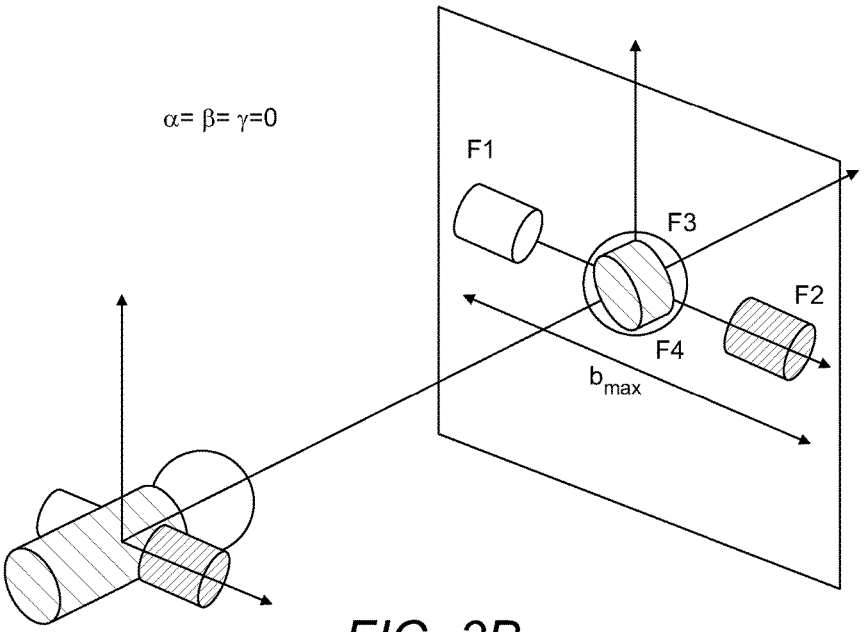
Figure 3C:
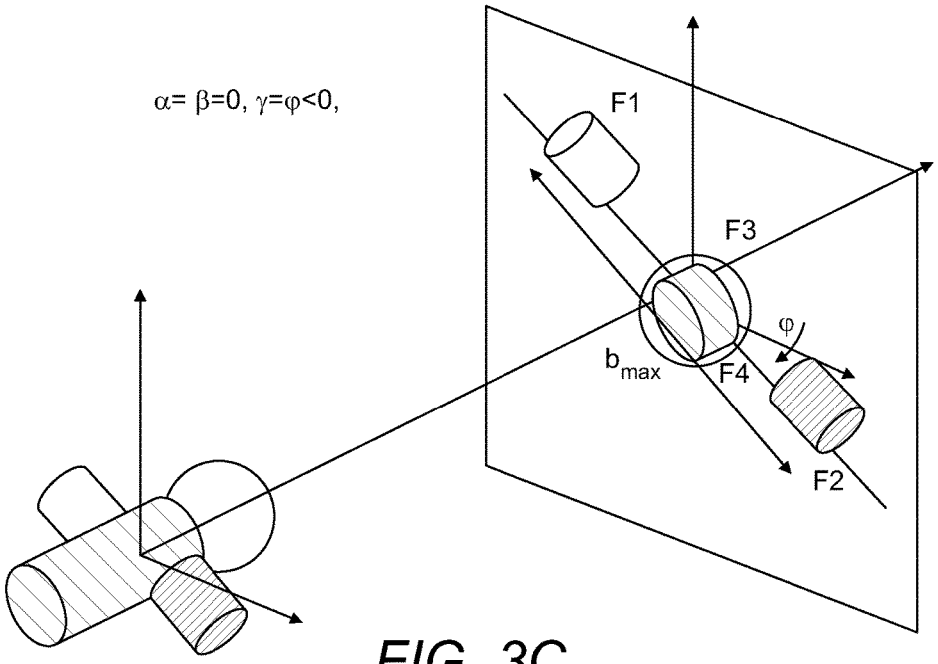
Figure 3D:
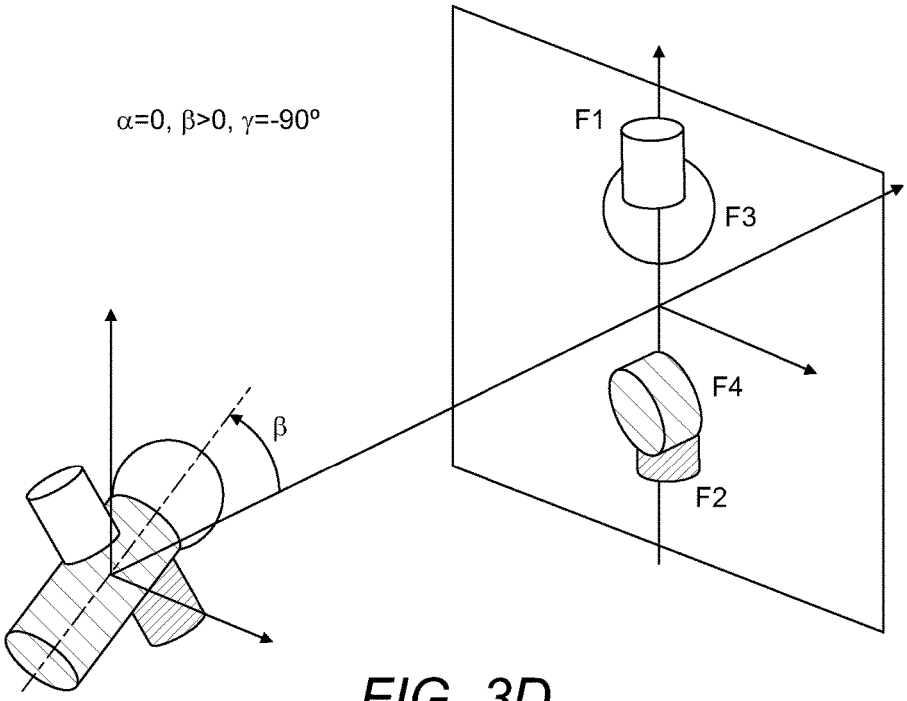
Figure 3E:
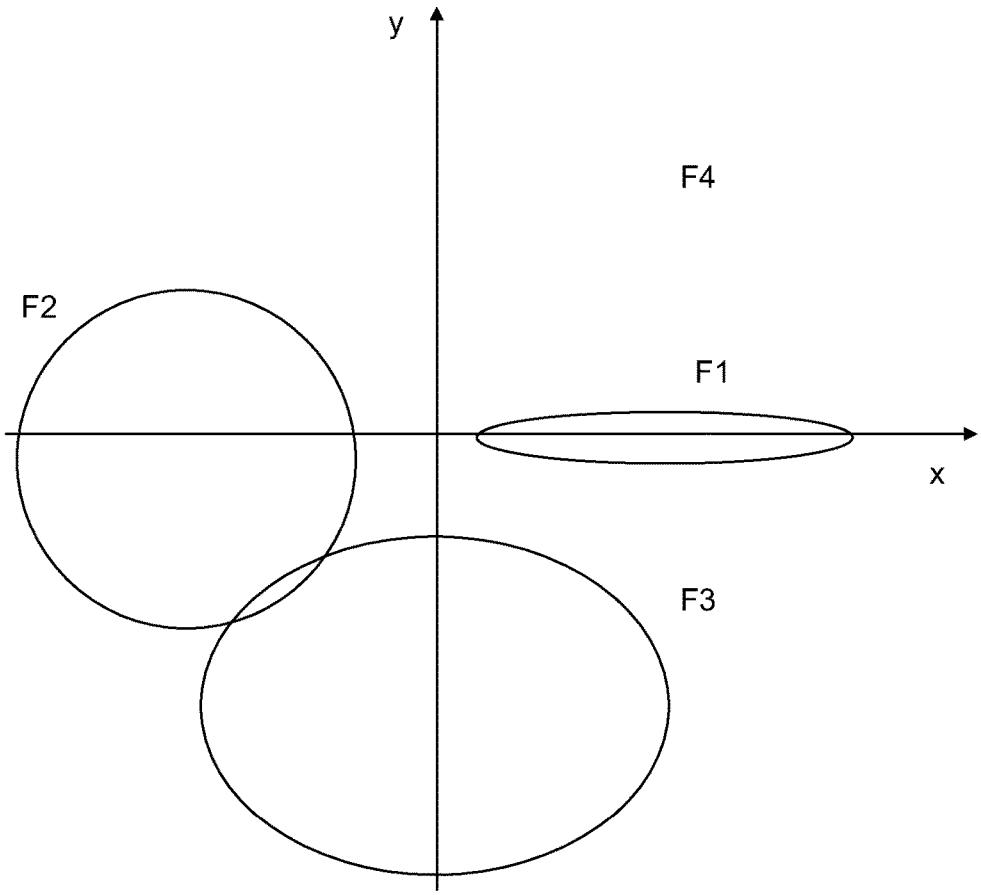

FIG. 3 shows again schematically how different variants of MMA orientation (characterised by angles $\alpha$, $\beta$, $\gamma$ relative to the direction towards the 2D detector 150) result in different fragment projections on the 2D detector 150. FIG. 3A shows the general case and FIGS. 3B-3D-specific cases which are especially amenable for reconstruction. Generally, the largest spread of fragments from the opposite sides of the molecules (exemplified as $b_{max}$ in FIG. 3) is expected when the original orientation of these fragments is parallel to the 2D detector 150.

Having collected the multiple three dimensional (m/z, x, y) images from multiple MMA precursor ions of the species of interest, processing and analysis continues on the basis of three-dimensional reconstruction techniques similar to those used in single-particle cryo-electron tomography.

The main distinction of the proposed method is that m/z information could be used as the first step towards clustering MMA images. All m/z spectra are clustered according to their similarity, thus separating different fragmentation pathways from each other. Then for the same fragmentation pathway, these highly similar mass spectra in each cluster have their (x, y) images rotationally aligned and grouped into multiple sets of high similarity of (m/z, x, y). For example, for aligning, the m/z with the highest signal intensity or the highest m/z may be assumed to orient along angle $\varphi=0$, and then all other signals are oriented relatively to this origin (see FIG. 3E). By averaging within such aligned sets, higher signal to noise ratio can be obtained.

Grouping is normally carried out using one of several data analysis and image classification algorithms, such as multivariate statistical analysis, cross-correlation and hierarchical ascendant classification, or K-means classification, etc. It is anticipated that, by analogy with single-particle cryo-electron tomography techniques, datasets up to tens of thousands of images are to be used, and an optimal solution is reached by an iterative procedure of alignment and classification, whereby strong image averages produced by classification are used as reference images for a subsequent alignment of the whole data set.

In a most straightforward implementation, after aligning and grouping the similar mass spectra, spatial constraints and correlations might be established, for example in pairwise manner even manually. Looking again at FIG. 2, suitable constraints might be A−D, A+B, C−E, C+D etc., (where the minus sign indicates that the two components of each pair are opposite each other relative to a centre of mass of the MMA precursor ion, and where a plus sign indicates that each MMA fragment ion is on the same side of the centre of mass of the MMA precursor ion).

It is desirable that the fragmentation conditions for the MMA precursor ions (for example, fluence wavelength, flat-top distribution of power density, timing and so forth) to be chosen in such a way that only required detail of information is revealed about the MMA precursor topography. For example, although highly schematic, FIG. 2 nevertheless shows the ideal case where the MMA precursor ion is fragmented only into its sub units. In reality, such an outcome is unlikely. Various alternative channels of fragmentation occur and this will in turn result in different combinations of sub units as well as fragments of the sub units themselves. It should be also expected that so called asymmetric fragmentation takes place, where most of the charge is carried away by smaller fragments, leaving larger fragments with disproportionately lower charge and hence efficiency of detection.

Thus, it can be summarised that the method allows three dimensional reconstruction of MMA structure, based on different views or alignments of the MMA precursor. It can be seen that the m/z of each fragment is determined from its time-of-flight and its position in the MMA relative to other fragments is determined from the coordinates (x, y) of detection by the 2D detector 150.

Conceptually the proposed method is analogous to the so-called velocity mapping technique broadly used in physics for studying photodissociation and molecular bonds of small molecules. The main distinction of the proposed method is not only a different object of investigation (high-mass MMA ions vs small neutral molecules), preferential use of individual MMA (and their constituents) detection but also focus on obtaining information not on bond energy but instead on mutual spatial positioning of fragments within the MMA structure. Nevertheless, modern techniques from velocity mapping may be employed to improve the quality of identification. For example, the described 2D detector is ideally suited for so-called time-slice velocity mapping (still under condition that not more than a single MMA is fragmented). In the time-slice approach (as described for example in S. Wu et al. *Molec. Phys.,* 103 (13) (2005) 1797-1807, and Jungmann et al, "A new imaging method for understanding chemical dynamics: Efficient slice imaging using an in-vacuum detector" Rev. Sci. Instr. (2010) 81 103112), the field strength in the acceleration gap 120 is significantly reduced. This means that the time-of-flight peak width of fragments is made so broad that it becomes significantly greater than the time resolution of the detector. Therefore it becomes possible to correlate the initial velocity of each fragment with the time slice in which it arrives at the detector. For example, only fragments with zero velocity would arrive at the detector at the time-of-flight strictly corresponding to their m/z.

Reduction of the extraction field could be complemented by the use of focusing lenses to keep the fragment distribution within the area of the 2D detector. Alternatively, the field could be completely switched during fragmentation and applied only after a certain delay (preferably, 200-3000 ns) that would allow the fragments sufficiently to diverge (so-called delayed extraction).

An accurate relation between the TOF and the m/z of fragment ions could be established during calibration (e.g. using well-cooled unfragmented CsI clusters), whilst an accurate m/z of the fragments could be determined using a high-resolution mass spectrometer as described below in the description. Those fragments with a non-zero initial velocity directed towards the 2D detector 150 would arrive earlier, whilst those fragments with an initial velocity away from the detector would arrive later. In its turn, the initial velocity is determined by the amount of energy released upon fragmentation, which could amount to several to several tens of eV. Most importantly for structural determination, conservation of momentum will necessarily ensure that this velocity is directed away from the center of mass of the MMA, thus permitting fragments to be related to each other.

Figure 4:
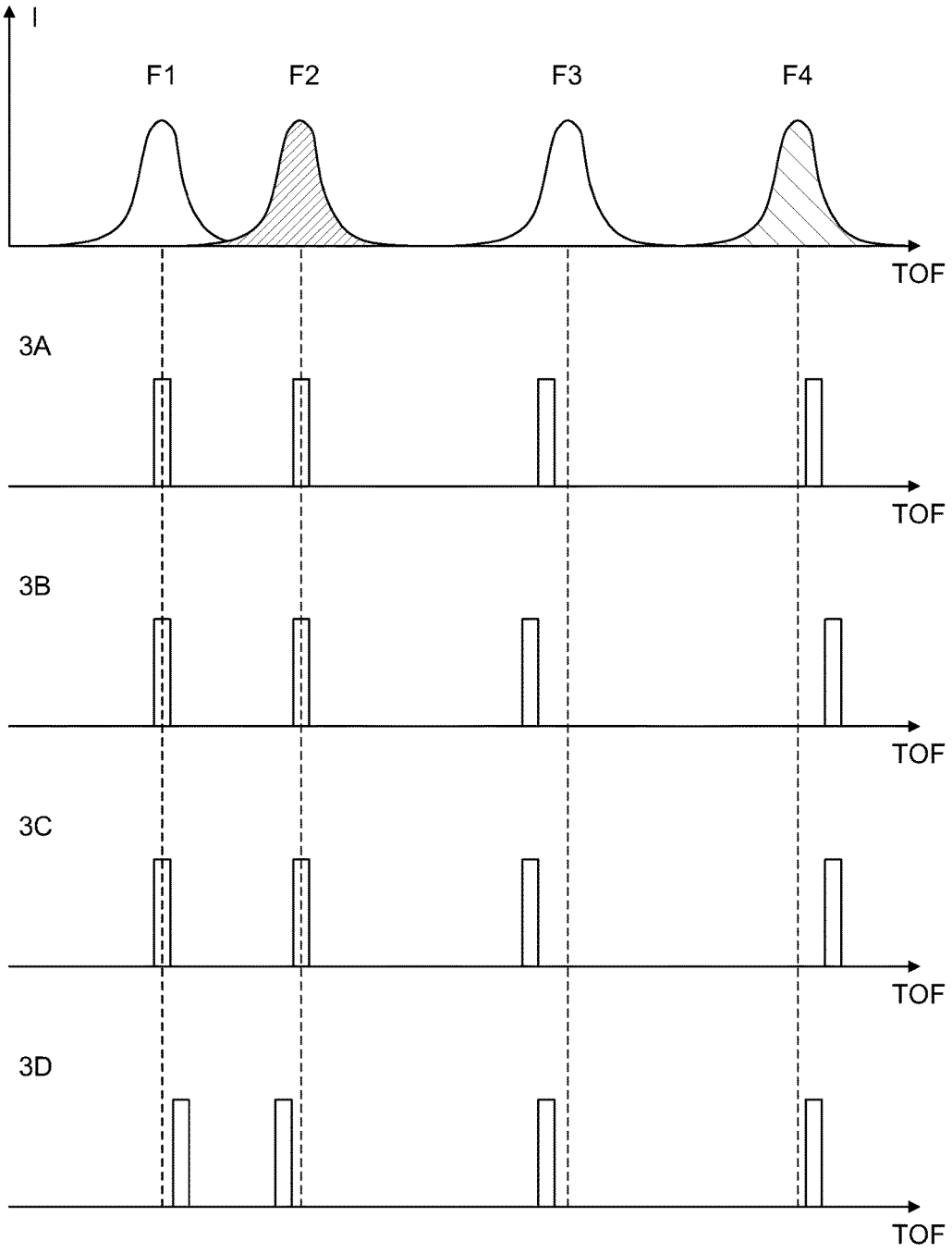
FIG. 4 shows how time-slice approach could be used to correlate relative orientation of MMA fragments with time of their arrival to the 2D detector.

This process is illustrated in FIG. 4. The top part of FIG. 4 shows a summed distribution for each fragment (from thousands of acquisitions). The remaining parts of FIG. 4 show, respectively (and from top to bottom) the distributions of times-of-flight for individual MMA from FIGS. 3A-D. For the most straightforward reconstruction of the 3D structure of the MMA, it is sufficient to select only those acquisitions where all or most of the fragments arrive at the central time slice, i.e. with all or most of the fragments lying originally in one plane (such as is shown in FIG. 2). Subsequently, corresponding spatial distributions (x, y) become much more amenable to alignment.

The foregoing describes a technique for determining the 3D structure of an MMA by an approach of 3D reconstruction. Further analytical information that can assist in the identification of the structure of the MMA may be obtained by operating the mass spectrometer of FIG. 1 in a second mode.

In that second mode, the electric field by the electrode arrangement 120 is reversed following fragmentation of MMA precursor ions. This results in the MMA fragment ions travelling in the reverse direction relative to the first mode of operation, that is, in a direction away from the detector arrangement 140 and back towards the HCD cell 80.

As a consequence of conservation of energy, the individual energy of each of the MMA fragment ions will be lower than the energy of the MMA precursor ions. Thus, by suitably adjusting the voltages on the multipole 90 prior to the HCD cell 80, that multipole 90 may store the fragment ions while further MMA precursor ions are arriving through the multipole for fragmentation in the fragmentation zone. In particular, the height of the potential well within the TOF analyzer 90 can be set such that relatively higher energy MMA precursor ions travelling into the multipole 90 from the HCD cell 80 will pass through the multipole 90 and thus will enter the fragmentation zone 110 for fragmentation, whereas relatively lower energy MMA fragment ions produced in that fragmentation zone 110 and directed back into the multipole 90 will be trapped by the multipole 90 for storage there.

It will be appreciated that the ability to commit MMA precursor ions to pass through the multipole 90 into the fragmentation zone 110, whilst the resultant MMA fragment ions travelling the reverse direction are trapped, is reliant upon efficient trapping of the MMA fragment ions in the reduced pressure of the multipole. This in turn may require fine balancing between the gas pressure in the multipole 90—which in turn originates from the HCD cell 80—and ion energy of the MMA fragment ions in particular.

The second mode of operation thus described permits the multipole 90 to be used to accumulate MMA fragment ions from multiple MMA precursor ions. For each individual MMA precursor ion, the pulse laser 100 creates the MMA fragments which are then accumulated and stored in the multipole 90 through application of a reverse electric field by the electrode arrangement 120.

Once sufficient numbers of fragment ions have been stored in the multipole 90, they may then be ejected again in a reverse direction into the HCD cell 80 where they may be cooled. The cooled MMA fragment ions then pass into the C-trap 60 where they are orthogonally ejected to the Orbitrap analyser 70 for high resolution analysis. There the ions are analysed with significantly higher m/z resolution than in the linear TOF 130. Any other high-resolution analyser could be also employed. This mode of operation is used to determine accurately all expected fragments of the investigated MMA.

Figure 5:
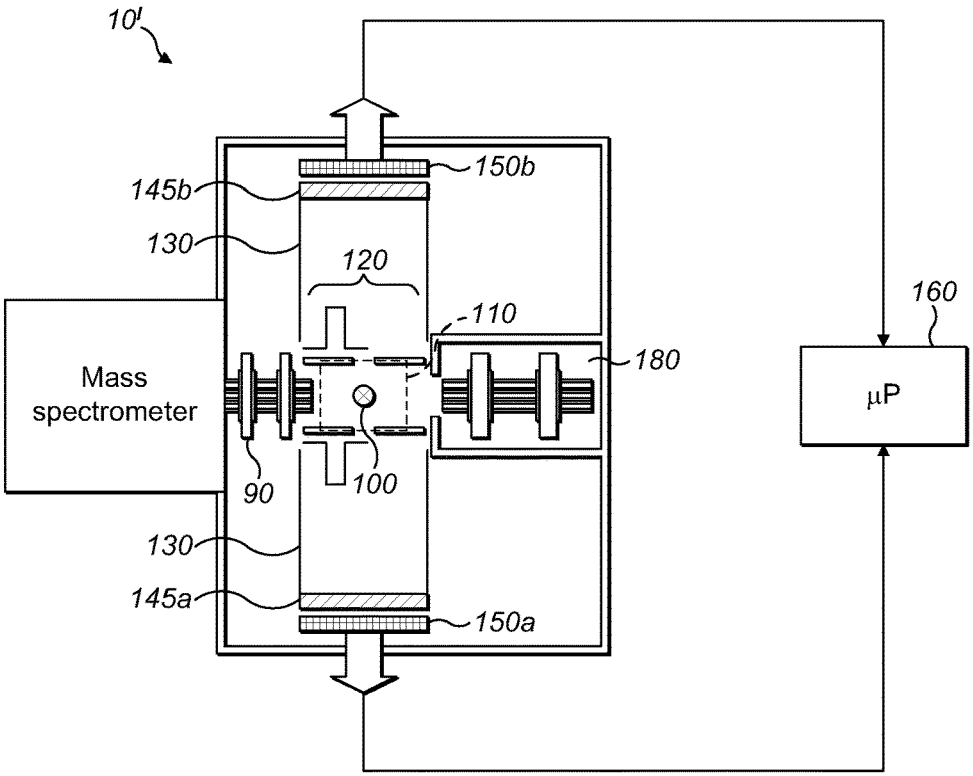
FIG. 5 shows a second embodiment of a mass spectrometer in accordance with the present invention, again with an electrode arrangement and a synchronised detector arrangement which differs from the detector arrangement of FIG. 1.

Turning now to FIG. 5, a second embodiment of a mass spectrometer in accordance with the present invention is shown. The components upstream of the multipole 90 of FIG. 1—that is, the ion source 20, first ion optics/bent multipole 30, quadrupole mass filter 40, second ion optics 50, C-trap 60 and Orbitrap 70, and the HCD cell 80, are common to FIG. 5 as well and are configured similarly. Thus, in order to simplify Figure AA, these components which are common to FIG. 1 are represented in FIG. 5 as a single block which has been labelled "mass spectrometer".

In FIG. 5, the detector arrangement 140 comprises a first MCP 145*a* in front of a first 2D detector 150*a*, and a second MCP 145*b* in front of a second 2D detector 150*b*. In contrast to FIG. 1, the first and second MCPs and 2D detectors are opposed to one another in a direction orthogonal to the flight axis of the mass spectrometer 10'.

An electrode arrangement 120 forming an acceleration gap, in FIG. 5 is (as with FIG. 1) arranged immediately downstream of the multipole 90 and on the flight axis of the mass spectrometer 10. However, first and second accelerating electrodes of the electrode arrangement 120 of FIG. 5 are orientated at 90° to the orientation of the electrode arrangement in FIG. 1. Specifically, each of the first and second accelerating electrodes has a central aperture aligned with a respective one of the MCPs/2D detectors. A fragmentation zone 110 is once again defined between the first and second accelerating electrodes of the electrode arrangement 120.

A pulsed laser 100 is provided to permit fragmentation of MMA precursor ions. The focus of the pulsed laser 100 is again aligned with the flight axis of the mass spectrometer 10' and also with the apertures in the first and second accelerating electrodes which face respectively towards each opposed part of the 2D detector. The direction of the pulsed laser beam is, in the view shown in FIG. 5, into the page, that is, orthogonal both to the longitudinal flight axis of the mass spectrometer 10' and also orthogonal to the direction of travel of resultant MMA fragment ions from the fragmentation zone 110 towards the first MCP 145*a* and the second opposed MCP 145*b*.

The mass spectrometer 10' of FIG. 5 also includes an ion storage trap (linear trap) 180. The linear trap 180 is located with its longitudinal axis and entrance aperture along the flight axis (longitudinal axis) of the mass spectrometer 10'. The entrance aperture of the linear trap 180 is on the opposite side of the fragmentation zone 110 and downstream of the electrode arrangement 120—that is, the entrance to the linear trap 180 opposes the exit of the multipole 90.

In use, MMA precursor ions exit the multipole 90 and enter the fragmentation zone 110. The pulsed laser 100 causes the MMA precursor ions to fragment. In a first mode of operation of the mass spectrometer 10' of Figure AA, a voltage—in the preferred embodiment, this is a pulsed voltage—is applied to the electrodes 120*a*, 120*b* of the electrode arrangement 120. The resultant electric field accelerates MMA fragment ions of a first polarity so that they travel in a first direction towards the first MCP 145*a* and the first 2D detector 150*a*, whilst MMA fragment ions of the opposite polarity travel in the opposite direction towards the second MCP 145*b* and second 2D detector 150*b*. As with the arrangement of FIG. 1, both parts of the detector arrangement 140 are in communication with a microprocessor 160 so that 3D images (m/z, x, y) for each 2D detector 150*a*, 150*b* may be synchronously or asynchronously collected and stored.

The capability to collect both positive and negative MMA fragment ions simultaneously may be particularly useful for analysis of membrane protein complexes or DNA/RNA-containing MMAs which might contain sub units of opposite polarities.

The linear trap 180 provides a convenient way in which to store fragment ions in a second mode of operation of the mass spectrometer 10'. In particular, with no voltage applied to the accelerating electrodes 120*a*, 120*b* of the electrode arrangement 120, MMA fragment ions created by an application of pulses of the pulsed laser 100 will not exit the fragmentation zone 110 in orthogonal directions (towards the parts of the detector arrangement 140) but will instead continue generally along the flight axis of the mass spectrometer 10' and will then enter the linear trap 180.

Where the mass spectrometer 10' is operating in this second mode, the purpose is to collect the MMA fragment ions for subsequent mass analysis using the Orbitrap 70 (FIG. 1). When seeking to obtain 3D images from the detector arrangement 150*a,b*, for the purposes of determining the topography of the MMA species of interest, it is, as explained above, desirable that fragment ions from only a single MMA precursor ion at once arrive at the detector arrangement 140, to simplify deconvolution of the resultant image data. For compositional analysis, however, where the ions are being captured in order to carry out high resolution mass analysis with the Orbitrap 70 instead, the concern to have, on average, only a single MMA precursor ion in the fragmentation zone at once does not exist. Hence, the pulsed laser 100 may, in the second mode of operation of the mass spectrometer 10' of FIG. 5, run at its maximum repetition rate so that MMA fragment ions may be stored in continuous or quasi continuous mode in the linear trap 180. For additional selectivity, the incoming flow of ions to the trap 180 could be gated in synchronization with the laser pulses to allow only ions subject to laser pulses from the focus region to enter the storage cell. Once sufficient numbers of MMA fragment ions have been captured in this second mode, they can be ejected back along the flight axis of the mass spectrometer 10', through the fragmentation zone 110 and multipole 90 and into the HCD cell 80. From this point they may be processed in the manner described above in connection with FIG. 1, i.e. cooled in the HCD cell 80, passed to the C-trap 60 and then orthogonally ejected to the Orbitrap 70 for high resolution mass analysis.

Still another detector arrangement embodying the present invention may be constituted by one or more detectors arranged so as to surround the fragmentation zone 110/electrode arrangement 120. For example, a circular or other generally arcuate configuration of a detector or detectors could be arranged in a plane around the fragmentation zone 110. The detector arrangement might comprise a single elongate detector which extends (curves) in a circumferential direction in that plane, and extends in a second longitudinal direction orthogonal to the plane so as to form a generally annular shaped detector arrangement. Alternatively the detector arrangement could comprise a plurality of separate 2D detectors each extending generally in the circumferential direction and positioned adjacent to one another in that direction, and again also extending in a direction perpendicular to the plane. Those individual detectors can themselves be substantially planar in both circumferential and longitudinal directions (so that when positioned adjacent to one another around the fragmentation zone they form a polygonal shape) or each detector can be curved in the circumferential direction so that each detector forms an arc of a circle for example. Likewise although the detector or detectors may be flat, planar and perpendicular to the plane of the detector arrangement, equally they may be tilted at an angle to that plane so as to form a frustoconical arrangement, or they may be curved so as to form a toroidal section instead. In these different detector configurations, the 2D detector nevertheless detects the ions in two dimensions (x, y) on the detector surface to provide a 2D (x, y) spatial distribution of the MMA fragment ions at the detector.

In use, the m/z of ions arriving at the detector arrangement could be detected along with the position of such ions; for example, the parameter "x" might represent the circumferential position of the ion around the detector arrangement, with the parameter "y" representing the position of the ion in the longitudinal direction. Such an arrangement permits detection of fragment ions in potentially any direction (ie in a 360 degree arc around the fragmentation zone 110), in a manner analogous to the particle tracking and event reconstruction techniques employed in particle physics.

Figure 6:
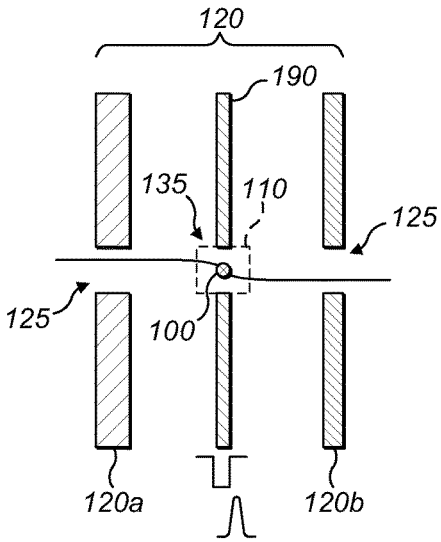
FIG. 6 shows an alternative electrode arrangement including to the electrode arrangements shown in respect of the mass spectrometers of FIGS. 1 and 5.

With such a detector arrangement, it may be desirable to employ extraction at alternating polarities through a gridded ring or otherwise shaped extraction electrode. The mass spectrometers 10 and 10' of FIGS. 1 and 5 respectively may be further improved by employing the modification shown in FIG. 6. FIG. 6 shows, in top sectional view, the electrode arrangement 120 of FIGS. 1 and 4 in addition to the first and second accelerating electrodes 120*a*, 120*b* of the electrode arrangement 120, each of which has a central aperture either generally along the flight axis of the mass spectrometer 10 (FIG. 1) or generally orthogonal thereto (the mass spectrometer 10' of FIG. 5), an additional thin plate electrode 190 is also provided. The thin plate electrode 190 is arranged parallel to the first and second accelerating electrodes 120*a*, 120*b* and has a central gap 135. The pulsed laser 100 is directed so as to propagate through the gap 135 in the thin plate electrode 190.

In the arrangement of FIG. 6, a high voltage pulse may be applied by the controller 170 (see FIG. 1) for several nanoseconds, across the gap 135 in the thin plate electrode 190. The controller controls the high voltage pulse so as to be applied just prior to the laser pulse from the pulsed laser 100. On that basis, only ions with the correct position relative to the thin plate electrode 190 are displaced by a transversal shift which is appropriate to intersect the laser beam. The result of this is that the fragmentation zone 110 is much smaller in volume than that of the mass spectrometers of FIGS. 1 and 5. In particular, MMA precursor ions are constrained in a small volume around the focal point of the pulsed laser 100. The volume might, for example, be a cylinder of approximate diameter 0.5-1 mm.

Furthermore, a strong electric field of about $10^7$V/m or higher might be employed so as to cause not only a transversal shift of MMA precursor ions but also alignment of the typically substantial dipole moment of MMA with the electric field. Particularly when employed in combination with cryogenic cooling in the HCD cell 80, this technique may provide additional constraint upon the orientation of the MMA precursor ions which in turn may assist in deconvolution of its structure. Particularly, if it may be assumed that one of the axes of the MMA species of interest lies in the same direction relative to the detector arrangement 140 for each generated 3D image, then the number of degrees of freedom in the problem to be solved (identification of structure by 3D reconstruction) is reduced.

The high voltage pulse applied to the thin plate electrode 190 in order to align the MMA precursor ion in accordance with its dipole moment ends with the end of the laser pulse, as the MMA precursor ion fragments. Then, a normal, uniform field may be applied to extract the MMA fragment ions towards the detector arrangement 140 (they are shown in FIG. 1 or as shown in Figure AA).

Where the mass spectrometer 10 or 10' is being operated in the second mode (high resolution mass analysis of multiple MMA fragments), there is no need to orient the MMA precursor ions prior to fragmentation.

Alignment of the MMA could be also implemented in the absence of strong electric field by means of two-colour non-resonant femtosecond laser pulses as described e.g. in Zhang et al. (Phys. Rev. A83 (2011) 043410), Kraus et al. (Phys. Rev. Lett. 109 (2012) 233903, arXiv:1311.3923 [physics.chem-ph]).

Although some preferred embodiments of the present invention have been described, it will be understood that these are for the purposes of illustration only and that various alternative arrangements are contemplated. For example, although as described in relation to the mass spectrometer 10 of FIG. 1 (and equally applicable to the mass spectrometer 10' of FIG. 5), MMA precursor ions arrive at the fragmentation zone 110 intact following ionisation in the ion source 10, this is by no means necessary. For example, the HCD cell 80 can be employed to carry out initial fragmentation of the MMA precursor ions into smaller fragments. Typically, the fragmentation mechanism for intact MMA precursor ions in the HCD cell 80 will be different from the fragmentation mechanism resulting from photodissociation in the fragmentation zone 110. Thus, preliminary fragmentation of intact MMA precursor ions before further photodissociation of those initial fragments in the fragmentation zone 110 may provide further helpful information in the identification and analysis of the structure and composition of the original MMA species of interest.

It is thus to be understood that, where the specification and claims refer to "MMA precursor ions", this is not to be understood to mean only intact, whole MMA ions, but also the fragments of those or even second or third generation fragments of those, as they enter the fragmentation zone 110 and are subjected to the pulsed laser 100 for fragmentation there. Moreover, although the described embodiments propose a quadrupole mass filter and an HCD cell between the ion source and the fragmentation zone 110, other mechanisms for MMA precursor ion selection and preliminary fragmentation with be apparent to the skilled reader. Moreover, arrangements to allow filtering/isolation of specific MMA precursor ions to be injected into the fragmentation zone 110 will be apparent to the skilled person.

Fragmentation of MMA ions in the fragmentation zone 110 may be carried not only by photons (e.g. with pulses of nanosecond, picosecond or femtosecond duration, with a wavelength anywhere between infra-red and vacuum ultraviolet, produced by a laser or a synchrotron), but also by collisions with gas (preferably following acceleration by many kilovolts), by an ion beam of the same or opposite polarity, or by an electron beam, for example. The main requirement for applicability of a fragmentation technique to methods embodying the present invention is the presence of a correlation between the final location of an MMA fragment on the 2D detector 150, and its original location within the MMA relatively to that MMA's center of mass. This requirement favours fragmentation means that enable fragmentation on the timescale faster than rotational period of MMA, i.e. faster than few nanoseconds, preferably in picoseconds range.

The 2D detector is not limited to a TimePix array but could be of another spatially resolved detector type such as a delay line detector, a CMOS-based active pixel detector, etc.

Moreover, the proposed techniques may be employed in combination with any other MS-based methods, using the same or separate instrumentation, to allow determination of all levels of the MMA structure, such as, but not limited to, HD exchange, cross-linking, affinity-tag MS, top-down and bottom-up proteomics, for determination of complementary fragments, foot printing MS, limited-proteolysis MS, ion mobility and so forth.

Although the foregoing description concentrates upon MMA precursor ions and their fragmentation into fragment ions for subsequent detection, it is in principle also possible to detect neutral molecules (fragments or neutralized precursors) that fly out through the HCD cell 80, provided that those neutral molecules pass the fragmentation zone 110 with sufficient energy. In that case, a third synchronized detector specifically configured to detect such neutral molecules may be desirable.

Finally, whilst high resolution mass spectrometry has been described herein in the context of an Orbitrap mass analyzer 70, other forms of high resolution mass analysis, for example Fourier transform mass spectrometry (FTMS), or time-of-flight mass spectrometry, could equally be employed to determine, to high resolution, the mass of MMA precursor or fragment ions. The main requirement to such high resolution analyser would be the ability to reliably identify fragments from mass spectra, which typically require mass resolving power in excess of 10,000-50,000 and mass accuracy better than 3-20 ppm.

The invention claimed is:

1. A method of analyzing a molecular species, comprising the steps of:

(a) generating precursor ions of a molecular species to be investigated;

(b) directing the precursor ions toward a fragmentation zone; and (c) switching between a first mode and a second mode of operation, wherein the first mode includes steps of:

(i) performing a plurality of fragmentation/detection events, wherein for each fragmentation/detection event, a m/z distribution of fragment ions is detected at an ion detector arrangement; and (ii) controlling a flow of the precursor ions into the fragmentation zone such that, averaged over the plurality of fragmentation/detection events, no more than one precursor ion is present within the fragmentation zone for each fragmentation/detection event; and wherein the second mode includes steps of:

(iii) performing a plurality of fragmentation events;

(iv) accumulating fragment ions formed during the plurality of fragmentation events; and (v) mass analyzing the accumulated fragment ions in a high-resolution mass analyzer.

2. The method of claim 1, wherein step (c)(i) further comprises detecting a spatial distribution of the fragment ions for each of the plurality of fragmentation/detection events.

3. The method of claim 1, wherein the molecular species is a macromolecular assembly (MMA).

4. The method of claim 1, wherein steps c(i) and c(iii) each comprise irradiating precursor ions in the fragmentation zone using a pulsed laser.

5. The method of claim 2, wherein the step (c)(i) of detecting the spatial and m/z distributions of the fragment ions comprises detecting the fragment ions using a two-dimensional detector which is positioned downstream of the fragmentation zone.

6. The method of claim 5, wherein step (c)(i) further comprises converting fragment ions into electrons at a micro-channel plate (MCP) positioned adjacent to and upstream of the two-dimensional detector, multiplying the number of electrons produced and directing the multiplied electrons to the 2D detector.

7. The method of claim 2, wherein step (c)(i) further comprises, for each precursor ion, generating a map of position and time-of-flight for each of the fragment ions produced therefrom, and analyzing together the plurality of maps generated from the plurality of precursor ions of the molecular species.

8. The method of claim 7, wherein the step of analyzing together the plurality of maps generated from the plurality of precursor ions of the molecular species comprises classifying and clustering each of the maps based upon a degree of similarity of mass spectra and/or spatial distributions and/or deviations of measured time-of-flights from expected ones for the corresponding fragment ions.

9. The method of claim 8, wherein the maps in each cluster have their (x, y) images rotationally aligned and grouped into multiple sets of high (m/z, x, y) similarity.

10. The method of claim 2, further comprising generating an electromagnetic field in or immediately upstream of the fragmentation zone so as to align an axis of the precursor ion in a fixed spatial direction.

11. A mass spectrometer comprising:

an ion source for generating precursor ions of a molecular species;

an ion detector arrangement having detector ion optics;

pulsed fragmentation means for fragmenting the precursor ions in a fragmentation zone positioned between the ion detector arrangement and the ion source;

ion optics for transporting the precursor ions from the ion source to the fragmentation zone;

a high-resolution mass analyzer; and a controller configured to switch the mass spectrometer between first and second modes of operation;

wherein, in the first mode, the controller causes the mass spectrometer to perform a plurality of fragmentation/detection events, each fragmentation/detection event including operating the fragmentation means to generate fragment ions within the fragmentation zone and detecting the fragment ions at the ion detector arrangement, and to control the flow rate of precursor ions into the fragmentation zone and the pulse rate of the fragmentation means such that, averaged over the plurality of fragmentation/detection events, no more than one precursor ion is present within the fragmentation zone; and wherein, in the second mode, the controller causes the mass spectrometer to perform a plurality of fragmentation events, each fragmentation event including operating the fragmentation means to generate fragment ions within the fragmentation zone, to accumulate the fragment ions generated in the plurality of fragmentation events, and to mass analyze the accumulated fragment ions in the high-resolution mass analyzer.

12. The mass spectrometer of claim 11, wherein the pulsed fragmentation means comprises a laser or synchrotron beam focussed upon the fragmentation zone.

13. The mass spectrometer of claim 11, wherein the ion detector arrangement includes a two-dimensional detector for detecting a spatial distribution of the fragment ions for each of the plurality of fragmentation/detection events.

14. The mass spectrometer of claim 13, wherein the ion detector arrangement further includes a micro channel plate (MCP) positioned in front of the two-dimensional detector, the MCP converting fragment ions arriving from the fragmentation zone into electrons, and multiplying those electrons prior to detection by the two-dimensional detector.

15. The mass spectrometer of claim 11, wherein the high-resolution mass analyzer is an orbital trapping mass analyzer.

* * * * *